US008667751B2

(12) United States Patent
Ladvie

(10) Patent No.: US 8,667,751 B2
(45) Date of Patent: Mar. 11, 2014

(54) SET OF ELEMENTS FOR CONSTRUCTING A WOODEN WALL AND METHOD FOR USING SUCH ELEMENTS

(75) Inventor: Jean-Pierre Ladvie, Crandelles (FR)

(73) Assignee: Wood Way, Aurillac (FR)

( * ) Notice: Subject to any disclaimer, the term of this patent is extended or adjusted under 35 U.S.C. 154(b) by 0 days.

(21) Appl. No.: 13/510,043

(22) PCT Filed: Nov. 17, 2010

(86) PCT No.: PCT/FR2010/052442

§ 371 (c)(1),
(2), (4) Date: Jul. 16, 2012

(87) PCT Pub. No.: WO2011/061445

PCT Pub. Date: May 26, 2011

(65) Prior Publication Data

US 2012/0272596 A1 Nov. 1, 2012

(30) Foreign Application Priority Data

Nov. 18, 2009 (FR) ..... 09 58135

(51) Int. Cl.
*E04B 1/10* (2006.01)
*E04C 5/08* (2006.01)

(52) U.S. Cl.
USPC ..... 52/223.7; 52/233

(58) Field of Classification Search
USPC ..... 52/223.7, 223.6, 223.1, 223.4, 233
See application file for complete search history.

(56) References Cited

U.S. PATENT DOCUMENTS

| | | | | |
|---|---|---|---|---|
| 3,478,482 | A | 11/1969 | Richard | |
| 6,041,566 | A * | 3/2000 | Allen | 52/837 |
| 6,883,281 | B1 * | 4/2005 | Chavez-Gandara | 52/284 |
| 2008/0184650 | A1 * | 8/2008 | Fischer | 52/606 |
| 2010/0043336 | A1 * | 2/2010 | Jensen | 52/604 |
| 2012/0144764 | A1 * | 6/2012 | Hanna | 52/173.1 |

FOREIGN PATENT DOCUMENTS

| | | | |
|---|---|---|---|
| CA | 1081911 | A1 | 7/1980 |
| GB | 2091777 | A | 8/1982 |
| WO | 2004/088057 | A | 10/2004 |

* cited by examiner

*Primary Examiner* — Mark Wendell
(74) *Attorney, Agent, or Firm* — Dowell & Dowell, PC

(57) ABSTRACT

The invention relates to a set of building elements comprising a first type of element (1, 1') provided with connecting members on four faces and designed to be stacked and butted together with at least one other element of the same type. The invention also comprises: at least one second type of element (24) designed to be attached to a flat surface and to form a base for receiving the first-type elements (1, 1'), and a third type of element (42) formed by cables capable of removably connecting the first-type elements (1, 1') to the second-type elements (24) under tension. Each cable (42) is inserted into a space defined between at least two walls of at least one element (1, 1') of the first type.

10 Claims, 9 Drawing Sheets

SET OF ELEMENTS FOR CONSTRUCTING A WOODEN WALL AND METHOD FOR USING SUCH ELEMENTS

BACKGROUND OF THE INVENTION

1. Field of the Invention

The invention relates to a set of elements for constructing a wooden wall. It also relates to a method for using such elements.

2. Brief Description of the Related Art

A wall refers to a partition or barrier, which may or may not be load-bearing, of a building. During the construction of a building, it is known to mount the walls, both outside and inside, from building elements such as concrete blocks or bricks. The use of these different elements requires the use of a binder. Aside from a relatively heavy weight, using bricks or concrete blocks leads to significant civil engineering work to produce the foundations. Furthermore, the very nature of the materials used frequently involves the use of additional insulation, the bricks and concrete blocks not having an optimal thermal insulation coefficient.

As an alternative to these elements, wood is used as construction material. Structures are in particular known that are made from round wood, commonly called Scandinavian structures, where wooden logs, which are generally cylindrical with a circular section, are stacked to form the walls of the building. These logs are attached to one another using a male/female-type connecting system, for example, slots receiving tabs. Such logs require a relatively complex implementation, with particular know-how to produce sealed connections between the logs. Furthermore, using wooden logs involves reacting play between the logs, after the latter have completely dried.

To produce wood walls more easily, WO-A-2004/088057 discloses rectangular wooden bricks, four surfaces of which are provided with slots making it possible to stack them and butt them together by inserting tabs into the slots. The stacked bricks are maintained relative to one another by reinforcing tubes inserted into holes formed in the bricks. These bricks are relatively complicated to use and require the use of an adhesive to fasten the tabs in the slots.

CA-A-1 081 911 describes wooden bricks whereof the upper and lower surfaces have complementary shapes, thereby allowing them to be stacked. A tab inserted into transverse slots formed in two bricks butted together ensures the connection of two juxtaposed bricks. Cables pass through the bricks and adjustably connect the stacked bricks to one another. The openings formed in the bricks for the passage of the cables create thermal bridges.

SUMMARY OF THE INVENTION

The invention proposes another type of building element allowing an easy assembly of these elements relative to one another, not requiring the use of an adhesive and not creating a thermal bridge.

To that end, the invention relates to a set of building elements comprising a first type of element provided with connecting members on four faces and designed to be stacked and butted together with at least one other element of the same type, comprising at least:

- one second type of element designed to be attached to a flat surface and to form a base for receiving the first-type elements, and
- a third type of element formed by cables capable of removably connecting the first-type elements to the second-type elements under tension, characterized in that each cable is inserted into a space defined between at least two walls of at least one element of the first type.

With these three types of elements, it is possible to produce a wall easily by stacking and connecting, under tension, the first- and second-type elements, without adhesive.

The passage of the cable in a space defined between two elements avoids piercing of the latter and the appearance of a thermal bridge.

According to advantageous, but non-mandatory aspects of the invention, such a set of building elements can incorporate one or more of the following features:

- The space is defined between webs of two adjacent elements, said webs connecting two parallel side walls of each element.
- Each second-type element includes a surface provided with openings that are regularly arranged and each capable of receiving a portion of a cable.
- The cables are positioned between the second-type elements and a first-type element arranged at the upper end of a column of first-type elements and provided with a member for maintaining the cable.
- The maintaining member is a tab generally configured in a Ω and provided with a piercing allowing the passage of one end of the cable.
- Each cable is inserted into a slot formed in a plate inserted into the space defined between two adjacent first-type elements.
- One first-type element is configured to produce the corners of the building.
- One first-type element is configured to form a housing for rolling slat blinds.

The invention also relates to a method for using such a set of elements according to one of the preceding features, comprising at least the following steps:

a) assembling second-type elements according to the plan for the walls to be built,
b) stacking first-type elements in at least one column on the second-type elements,
c) positioning a third-type element, i.e. the cable, between the element located at the top of the column and the second-type element forming a base for the column,
d) inserting the cable into the spaces,
e) putting the third-type element under tension,
f) stacking first-type elements adjacent to the first already-stacked first-type elements in another column.

The invention also relates to a building comprising at least one wall made from a set of elements according to one of the preceding features.

BRIEF DESCRIPTION OF THE DRAWINGS

The invention will be better understood, and other advantages thereof will appear more clearly, upon reading the following description of a set of building elements according to several embodiments of the invention, provided solely as an example and done in reference to the appended drawings, in which.

DESCRIPTION OF THE PREFERRED EMBODIMENTS

Figure 1:
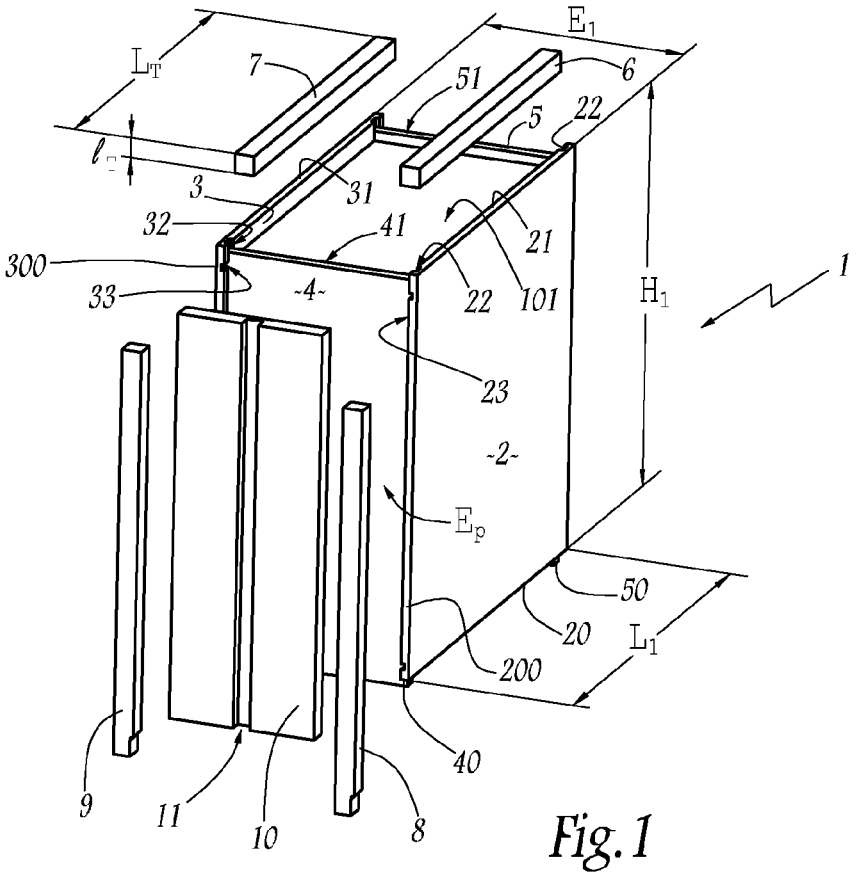
FIG. 1 is a perspective view of a first-type element according to one embodiment of the invention, shown with portions in the pre-mounting configuration.
Figure 2:
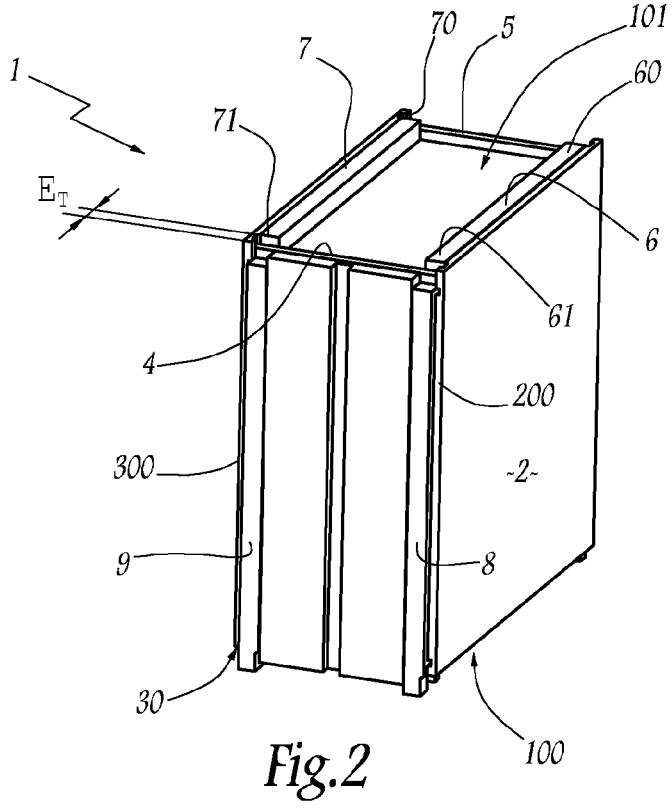
FIG. 2 is a view similar to FIG. 1, the element being shown mounted.

The element 1 or brick 1 shown in FIGS. 1 and 2 is a first-type element, generally in the shape of a rectangular rhomb. Alternatively, it may be a square rhomb. This element 1 is advantageously made from a cellulose-based material, for example class 4 OSB (Oriented Stand Board) panels, i.e. glued wood laminate panels working under high stresses in a moist environment.

The element 1 is advantageously hollow, i.e. in the form of a box in which a thermal and/or acoustic insulating material is arranged in bulk or in sheets during manufacture. In the case at hand, mineral wool is inserted into said element 1. Alternatively, cellulose wadding or another insulating material is used. In another embodiment, the element 1 is solid, and can then be made from another material, which itself is advantageously thermally and/or acoustically insulating.

The elements 1 have predefined sizes in terms of length, width and thickness. Typically, the height $H_1$ of an element 1 is comprised, for current structures, between 35 and 65 cm, at 5 cm intervals. In other words, bricks are obtained whereof the heights $H_1$ are 35, 40, 45, 50, 55, 60 or 65 cm. The length $L_1$ of such a brick advantageously varies from 30 to 60 cm at 10 cm intervals.

These dimensions make it possible to produce walls of different sizes by using elements 1 with an adapted height $H_1$ and width $L_1$. The thickness $E_1$ of these elements 1 varies from 60 mm to 600 mm. It should be noted that elements 1 with different dimensions $H_1$, $L_1$, or even a different thickness $E_1$, can be used to mount a same wall.

To mount a wall, at least elements whereof the width $L_1$ is 30, 40 or 50 centimeters for a height $H_1$ of 35, 40 or 45 centimeters should be used.

The different surfaces of an element or brick 1 are sealably connected, so that the insulating material inserted into the volume of the brick 1 is not in contact with the outside. This makes it possible to limit any condensation or moisture phenomenon on the wall.

The parallel side panels or walls 2 and 3 of the element 1 are connected by parallel webs 4 and 5. The webs 4 and 5 are the same height as the walls 2 and 3. They are positioned, relative to FIG. 1, so that their lower ends 40, 50 protrude past the lower ends 20, 30 of the side walls. As a result, the upper ends of the webs 4, 5, respectively 41, 51 opposite the ends 40, 50 are withdrawn relative to the upper edges 21, 31 of the walls 2, 3. In other words, a male-type connecting member 20, 30, 40, 50 is defined on a lower surface 100 of the element 1, and a female-type connecting element 21, 31, 41, 51 adapted to receive the male elements 20, 30, 40, 50 of another element 1 of the same type is defined on the opposite upper surface 101 thereof. The lower 100 and upper 101 surfaces are delimited by flat plates 100, 101.

Cleats 6 and 7 are positioned at each of the surfaces. Only the cleats situated on the plate 101 are visible in FIGS. 1 and 2. The length $L_T$ of each cleat 6, 7 is slightly smaller than the length $L_1$ of the walls 2, 3, so as to form, between the ends 60, 61, 70, 71 of the cleats 6 and 7 and the webs 4 and 5, a space with width $E_T$ corresponding to the thickness of the ends 40 and 50 of the webs 4, 5 of a brick 1.

The cleats 6, 7 have a square section in the case at hand. They have sides with a width $I_T$ slightly larger than that of the space between the surface 101 and the ends 21 and 31 of the walls 2, 3. Thus, the cleats 6, 7 of a first element 1 can be partially inserted into the space delimited between the surface 100 and the ends 20, 30 of a second element 1 placed above the first element 1. In other words, the cleats 6 and 7 are positioned in the space Es available between two superimposed elements 1. In this space, a plate (not illustrated) of a thermally and/or phonically insulating material is advantageously inserted, for example rock wool.

The webs 4 and 5 are attached on the walls 2, 3 so that they are withdrawn from the vertical edges 200, 300 of the panels 2, 3. To that end, the webs 4, 5 are inserted into grooves 22, 32 formed in the opposite surfaces of the panels 2, 3. In this way, when two elements 1 are butted together, i.e. with their respective webs 4, 5 facing one another, the latter do not touch and a space Ep is formed between the webs 4, 5 of the two adjacent elements 1.

Cleats 8 and 9 are inserted into this space. Their dimensions are such that they bear on two portions 22, 33 of the panels 2 and 3 situated between the edges 200, 300 and the webs 4 and 5. These cleats 8, 9 thus participate in maintaining and guiding the elements 1 butted together.

A plate-shaped element 10 is inserted into the space Ep thus defined between the webs 4 and 5 of two elements 1 butted together and the cleats 8 and 9. This element 10 is advantageously made from a thermally insulating material that is advantageously flexible, for example rock wool or wood fiber. The plate 10 is provided with a longitudinal slot 11 extending in the median position over the entire length thereof.

Alternatively, when the plate 10 is made from a flexible enough material, it is not necessary to provide a slot 11 therein.

The cleats 6 to 9 and the insulating plate 10 are removably mounted between the elements 1. To that end, they bear on the walls 2, 3 and the webs 4, 5 of the element 1. Alternatively, they are glued and/or nailed on at least one element 1.

Thus equipped with cleats 6 to 9, it is possible to connect the elements 1 to one another by snapping. Advantageously, each element 1 can be connected, in two perpendicular planes, to four other neighboring elements 1. Conventionally, in light of FIG. 3, a plane is said to be vertical when the elements 1 are positioned above one another, by cooperation between the members 20, 30, 40 and 50 of an element 1 inserted into the housings delimited by the ends 21, 31, 41 and 51 of another neighboring element 1 situated below.

Figure 3:
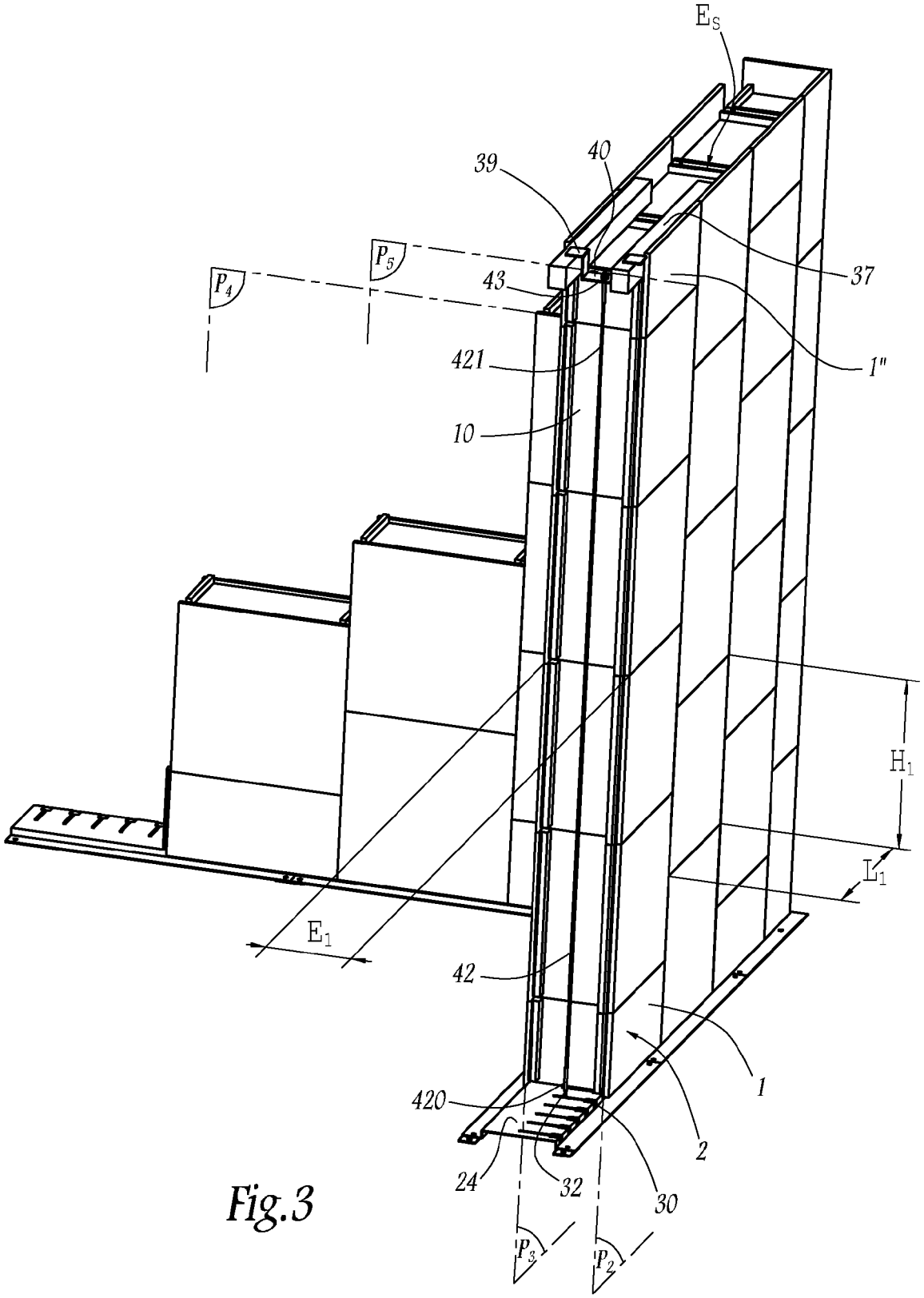
FIG. 3 is a partial perspective view, on a different scale, of a portion of two perpendicular walls mounted with first-, second- and third-type elements according to one embodiment of the invention.

As illustrated in FIG. 3, the walls 2 and 3 of two stacked elements 1 are situated in two parallel planes $P_2$, $P_3$ and the webs 4 and 5 of these same stacked elements 1 are also situated in two parallel planes $P_4$, $P_5$. In other words, the surfaces 2, 3 and 4, 5 of the different elements 1 thus connected are aligned. In this configuration, the cleats 8 and 9 and the slots 11 of the stacked elements 1 are also aligned.

However, in light of FIG. 3, the lower 100 or upper 101 surfaces of two elements 1 butted together, and not stacked, are not situated in a same plane. The elements 1 are butted together in staggered rows so as to better distribute the forces when a wall is mounted. To produce a wall as illustrated in FIG. 3, elements 1 with a same thickness $E_1$, a same width $L_1$, but different heights $H_1$ are used. Aside from greater stress resilience, such an arrangement of the elements 1 makes it possible to improve the esthetic appearance of the wall.

Figure 5:
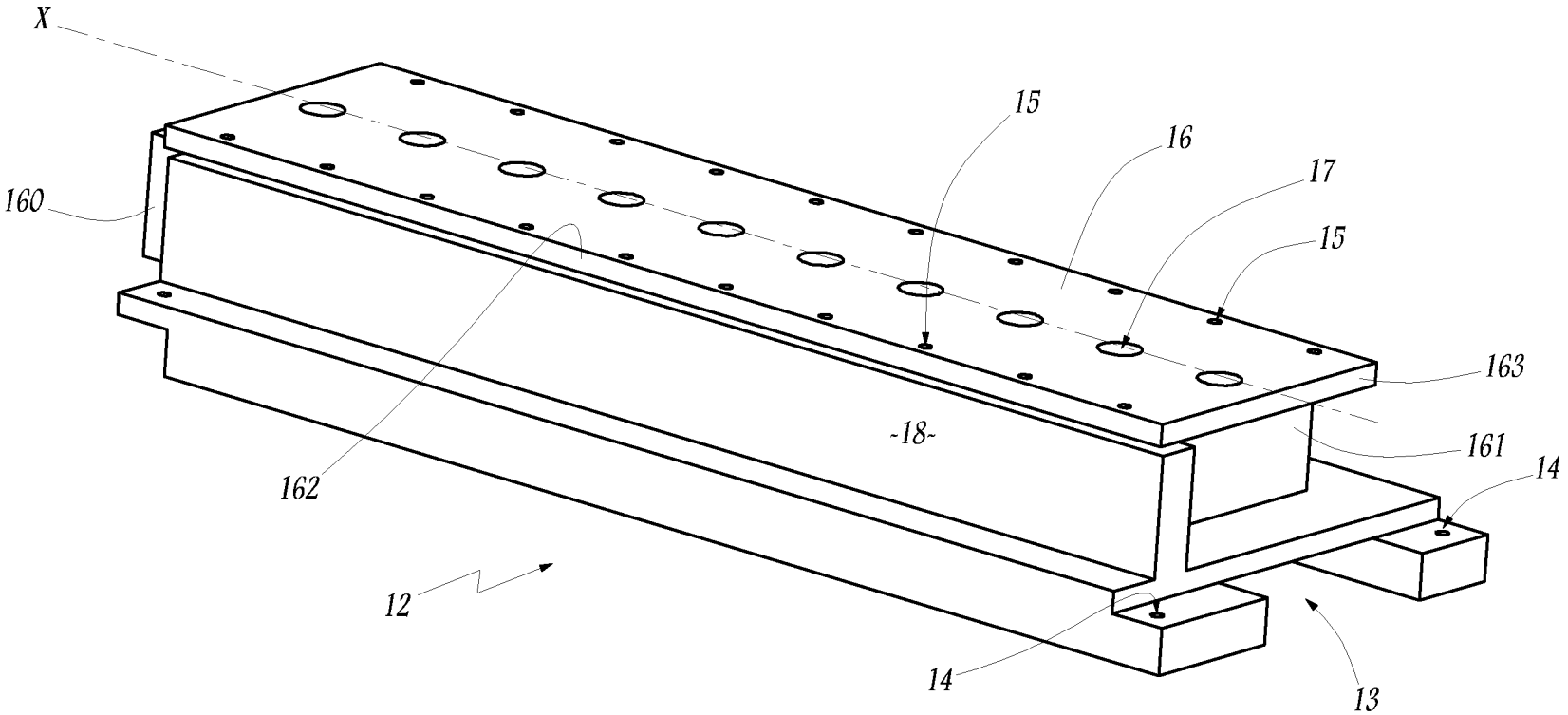
FIGS. 5 and 6 are larger-scale general views of two embodiments of second-type elements according to the invention.
Figure 6:
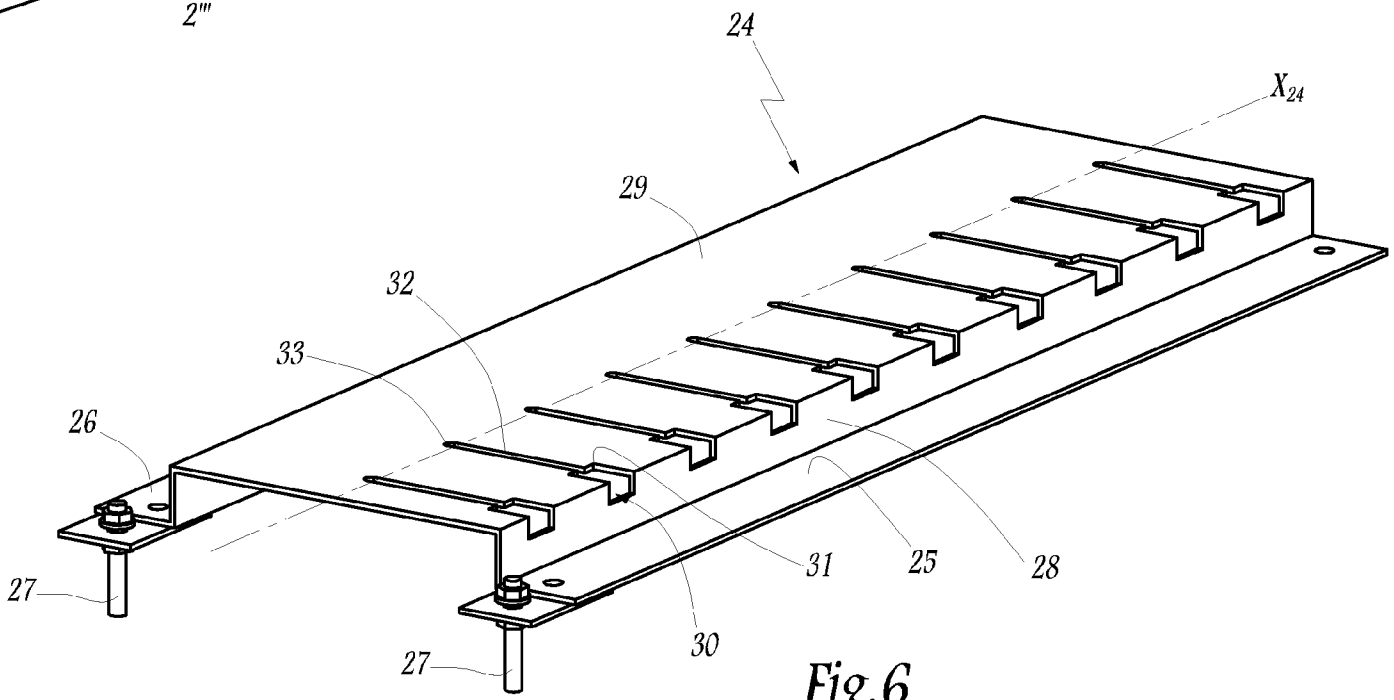
Figure 7:
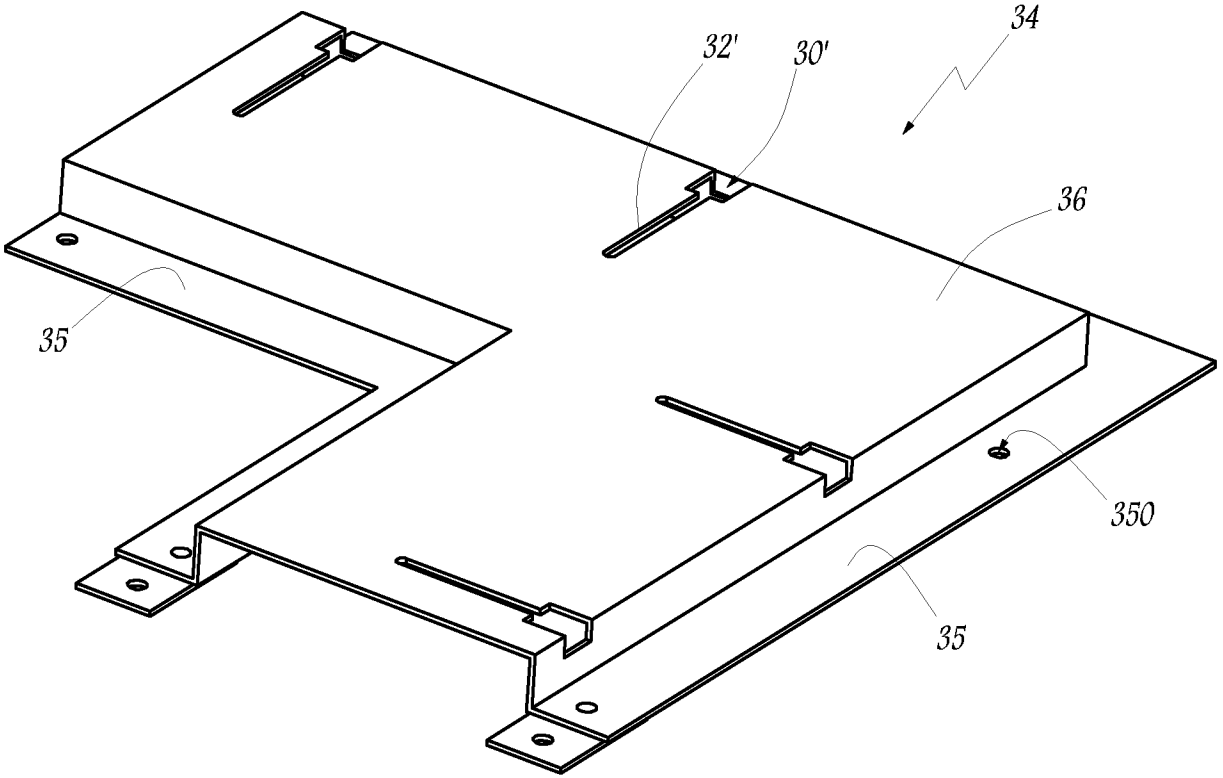
FIG. 7 is a general view, on the same scale as FIG. 6, of a second-type element, corresponding to an embodiment illustrated in FIG. 6 and used to mount two perpendicular walls.

The assembly of the elements 1, either in the vertical direction or in the horizontal direction, is not done directly on a flat surface, but on a second-type element 12, 24, 34. This element 12, 24 or 34 forms a base or plate for receiving stacked elements 1. De facto, the bases 12, 24, 34 provide a seat for the wall. FIGS. 5 to 7 illustrate two embodiments of such a base.

In FIG. 5, the base 12, with an elongate shape and a substantially rectangular section, comprises a main body 13. This body 13 is maintained, for example by screwing, on a slab or in the ground, owing to openings 14 for the passage of threaded rods or screws, not shown. The body 13 comprises a flat upper platen 16 provided with two types of openings 15 and 17. The openings 15, which are circular, are aligned and regularly arranged in two parallel rows, distributed in the vicinity of the longitudinal edges of the platen 16. The openings 17, which are also circular, have a larger diameter than the openings 15. They are aligned in a direction generally combined with a longitudinal axis X of the platen 16.

This platen 16 rests on flanks 160, 161 that are respectively protruding and withdrawn relative to the ends of the platen 16. One side 162 of the platen 16 bears on the free end of a web or flank 18 belonging to the body 13. The side 163 of the platen 16 opposite the side 162 extends beyond the flanks 160, 161. With such a configuration, the platen 16 forms a cover. The body 13 is open on one side, which allows a user to access the lower surface of the platen 16.

FIG. 6 illustrates another, preferred embodiment of a second type of element 24 forming a base. This base 24 is formed by a flattened, elongate piece having a transverse section generally in the shape of an upside-down U or a Ω. The ends of the arms of the U are bent toward the outside and form tabs 25, 26 provided with fastening members 27, screws in the case at hand, making it possible to mount the base 24 on a flat surface, for example a slab (not illustrated).

At the junction between an arm 28 and the bottom 29 of the base 24, several cutouts 30 are formed. These cutouts 30 are regularly arranged. The bottom 31 of each cutout 30 extends through a slot 32 whereof the closed end 33 is substantially situated in the median position on the bottom 29. In other words, the ends 33 of the slots 32 are aligned along a longitudinal axis $X_{24}$ of the base 24.

The use of these two types of support 12 and 24 will be described later. It should be noted that the first-type elements are adapted as a function of the support 12, 24 on which they are mounted.

FIG. 7 illustrates another element 34, according to an alternative of the second embodiment of the second-type element, making it possible to form a base for walls mounted perpendicular relative to one another. This element or base 34 comprises, similarly to the base 24, a flattened piece, in the shape of a square, with a transverse section generally in the shape of an upside-down U or a Ω. Tabs 35, formed by the folded ends of the piece, make it possible to attach the base 34 on a surface using members, not shown, inserted into piercings 350 formed in the tabs 35.

The bottom 36 of the U is provided with cutouts 30' extended by slots 32', identical to those formed on the base 24. The closed ends of the slots 32' are aligned in the median position of each branch of the base 34. In other words, the base 34 is an element similar to the base 24, but configured in a square. It is possible to align one or more bases 24 with the branches of a base 34 to mount walls at a right angle.

The mounting of the first-type elements 1 on second-type elements 12, 24 or 34 forming a base will now be described.

To mount a wall, the necessary number of bases 12, 24 or 34 are butted together, according to the plan for the building. The bases 12, 24, 34 are attached permanently or, advantageously, removably in the slab or ground. In all cases, it should be verified that the upper surfaces 16, 29, 36 of these bases, 12, 24, 34, respectively, are coplanar. The elements 1 forming a first row of the wall to be mounted are positioned on said surfaces 16, 29, 36. The dimensions and number of the elements 1 are adapted to the dimensions of the wall to be produced.

To that end, from the plan for the building, a layout is first done making it possible to optimize the mounting of the walls. The layout consists of defining the location and position of the minimum number of elements 1 necessary to produce a given wall. The guiding in position of the elements 1 on the bases 12, 24 and 34 is done by the ends 20 and 30 of the walls 2 and 3 bearing against the outer surfaces of the branches 28 of the U making up the bases 24 or 34. In the event bases 12 are used, pins (not illustrated) are inserted into the holes 15 and into holes with a complementary shape formed in the ends 20, 30 of the panels 2, 3.

When a row of elements 1, for example the first, is made on the bases 12, 24 or 34, the cleats 8 and 9 as well as the insulating plate 10 are inserted between two elements 1 butted together. The dimensions and position of the elements 1 are adapted so that the slots 11 of the plates 10 are aligned with the openings 17 or the cutouts 30, 30' of the bases 12, 24 or 34, respectively.

Figure 8:
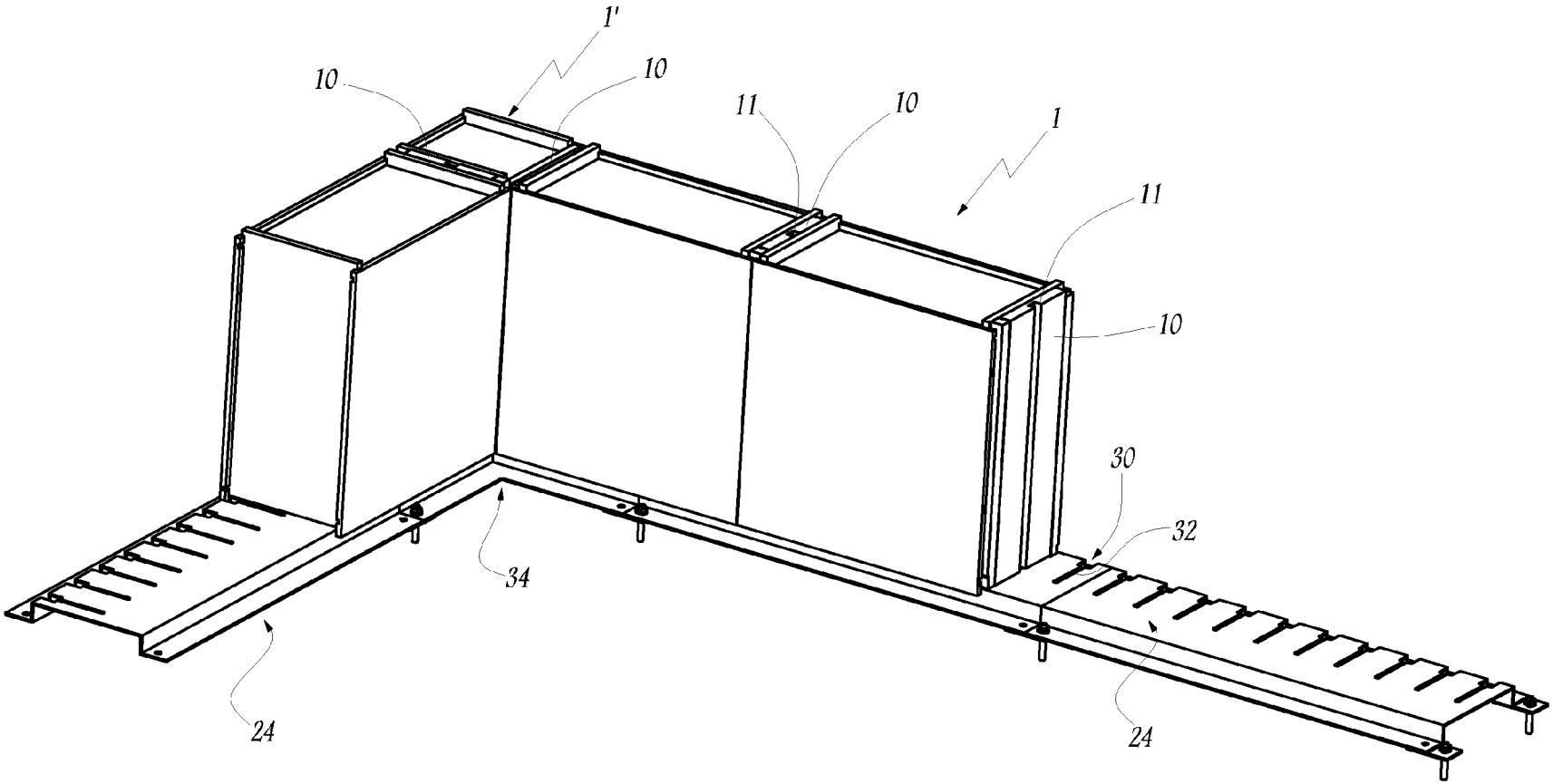
FIG. 8 is a partial perspective view, on a different scale, of a first row of first-type elements mounted on the element illustrated in FIG. 7 and on elements as shown in FIG. 6.

To make a corner, an element 1' illustrated in FIG. 8 is used. This element 1' has a square transverse section. It has two perpendicular surfaces each capable of receiving cleats 8 and 9 and an insulating element 10.

Figure 11:
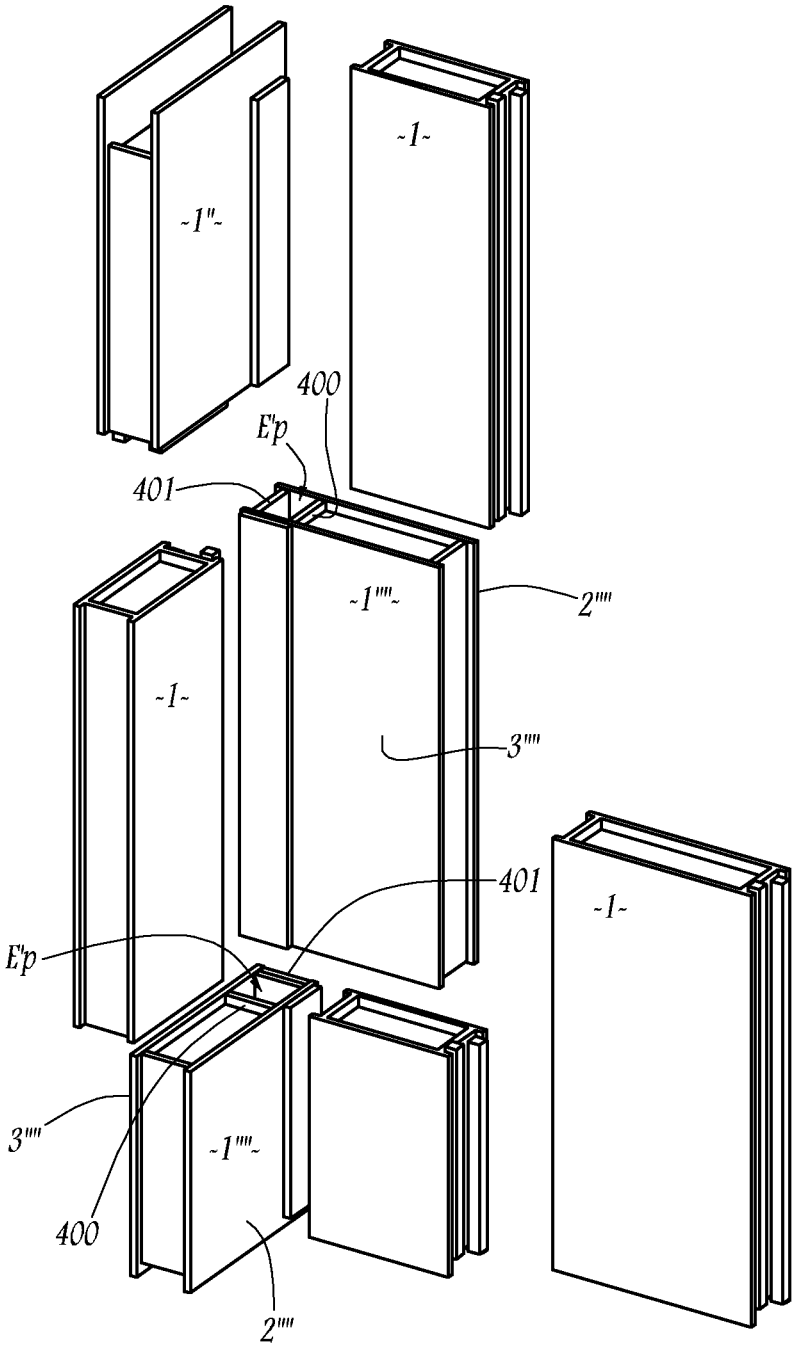
FIG. 11 is a perspective view, on a different scale, of first-type elements, in the pre-mounting position, adapted to form the corners of a building according to another embodiment.

FIG. 11 illustrates another embodiment of elements 1"" intended to form the corners. These elements 1"" have a space Ep' delimited by two parallel webs 400, 401 connecting the walls 2"" and 3"". In other words, the web 401 delimiting the space Ep' with the web 400 is not attached on another element 1"", but on the same element. In this way, at the end of the element 1"", a space Ep' is formed allowing the passage of the cable 42. In one alternative not shown, an insulating material, in the form of a flexible plate, can be inserted into that space Ep'.

By arranging these elements 1"" in staggered rows, like concrete blocks, the spaces Ep' of the stacked elements 1"" are vertically aligned. Elements 1 of different lengths are used to complete the mounting of the wall.

As illustrated in FIG. 3, the desired number of elements 1, 1' are mounted on one another so as to reach a predetermined wall height. As previously indicated, mounting is done in staggered rows in the vertical dimension.

In the upper portion of the wall, to finish the mounting thereof, so-called end elements 1" are used. The elements 1" are butted together like the elements 1, 1', i.e. by inserting cleats 8 and 9 and an insulating plate 10 between two elements 1". These elements 1", shown in FIG. 4, have the edges 21', 31' of the panels 2' and 3' that extend above the surface 101' over a height greater than that of the edges 21, 31 of the elements 1. A space $E_{37}$ is thus delimited between the edges 21', 31' and the surface 101'. These butted-together elements 1" of the cleats 37, which have a large length and transverse dimensions larger than the dimensions of the cleats 6 to 9 previously used, are arranged on the upper surfaces 101' of these elements 1".

At the junction zones between two elements 1" butted together, i.e. on the end of each plate 10, a tab 38, advantageously made from metal, generally configured in a Ω, is arranged. The ends 39 folded toward the outside of each tab 38 bear on the cleats 37. The bottom 40 of each tab 38 is provided with an opening 41 whereof the position and dimensions are adapted to overhang the slot 11 when the tab 38 is in position.

As illustrated in FIG. 3, a tension member, in this case a cable 42, is inserted into the base 24 from the cutout 30 to the bottom 33 of the slot 32. The distance between two adjacent cutouts 30 is adapted so that the cutouts 30 are always aligned with the slots 11 of the stacked elements 1, 1', 1", given the different widths $L_1$ thereof.

The cable 42 thus forms a third type of element making it possible to removably block the stacked elements 1, 1', 1" in tension.

The cable is put into place when a column of elements 1, 1', 1", 1"" has been mounted, before placing an adjacent column. The lower end 420 of the cable 42, in light of FIG. 3, ends with a head, not illustrated, making it possible to block the end 420 of the cable 42 in the slot 32 without the latter being freed. The upper end 421 of the cable 42 is advantageously threaded. It is inserted into the opening 41 of the tab 38 and, using a bolt 43, blocked so as to maintain the tension of the cable 42. The tension is predefined and the bolt 43 is advantageously tightened using a dynamometric key. In this way, when each cable 42 is tensioned, the column of stacked elements 1, 1', 1", 1"" is gripped between the tab 38 and the base 12, 24 or 34. The latter are thus maintained and the connections rigidified, in the vertical plane, between the elements 1, 1', 1", 1"". The connection between the adjacent columns of elements 1, 1', 1", 1"" is done by the cleats 37 and by the cleats 8, 9. Alternatively, the latter can be nailed, glued or screwed on the elements 1, 1', 1", 1"".

Figure 4:
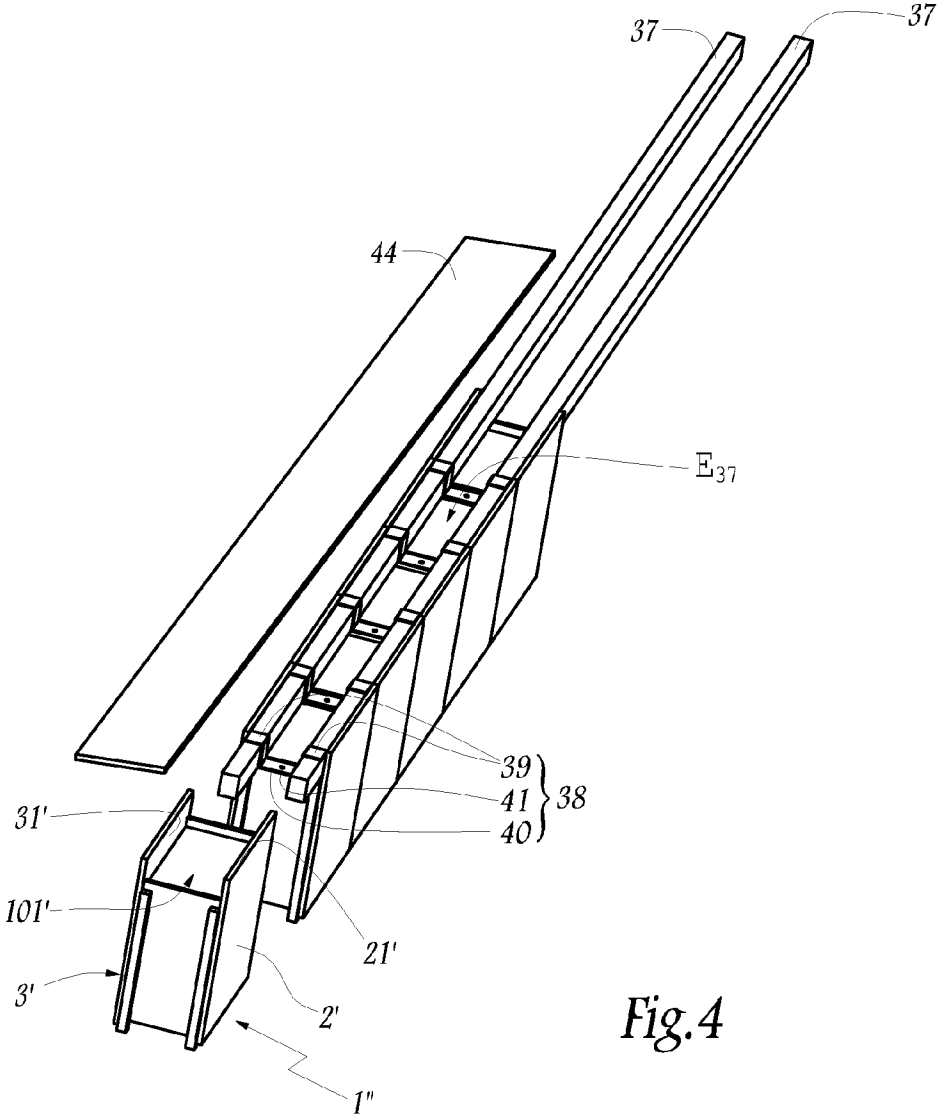
FIG. 4 is a larger-scale partial view of the upper end row of a wall similar to that shown in FIG. 3, complementary elements being in a pre-mounting configuration.

When a wall is thus made, i.e. when several columns of elements 1, 1', 1" that have been tensioned are secured together, a finishing element is arranged on the surfaces 101' of the elements 1", in this case a board or cover 44, visible in FIG. 4, making it possible to finish the wall while isolating the elements 1, 1', 1" thus connected.

The elements 1, 1', 1", 1"" are mounted in a manner similar to that previously described if the bases 12 illustrated in FIG. 5 are used. In that case, an end head of the cable 42 is inserted under the platen 16 through the open portion of the base 12. The cable 42 is inserted into the piercing 17. The head making it possible to block the cable 42, when the latter is in place, has dimensions adapted to those of the opening 17.

Figure 9:
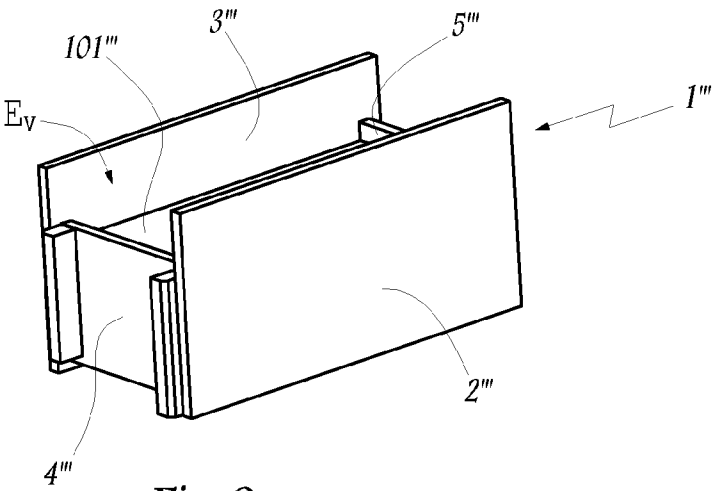
FIG. 9 is a smaller-scale perspective view of a first-type element according to one embodiment of the invention and including a housing for rolling slat blinds.

When one wishes to incorporate rolling slat blinds, for example above a window or bay window, an element 1"' like that described in FIG. 9 is used. In the upper portion, between the two panels 2"' and 3"' and above the flanks 4"' and 5"', rolling slat blinds (not shown) are inserted. In fact, this element 1"' is a first-type element whereof the space Ev between a surface 101"' and the ends of the panels 2"', 3"' and flanks 4"', 5"' is adapted to the size of the rolling slat blinds. If necessary, the surface 101"' is removed, and the element 1"' is then upwardly open. Otherwise, the element 1"' is similar to the first-type elements 1, 1' or 1".

Figure 10:
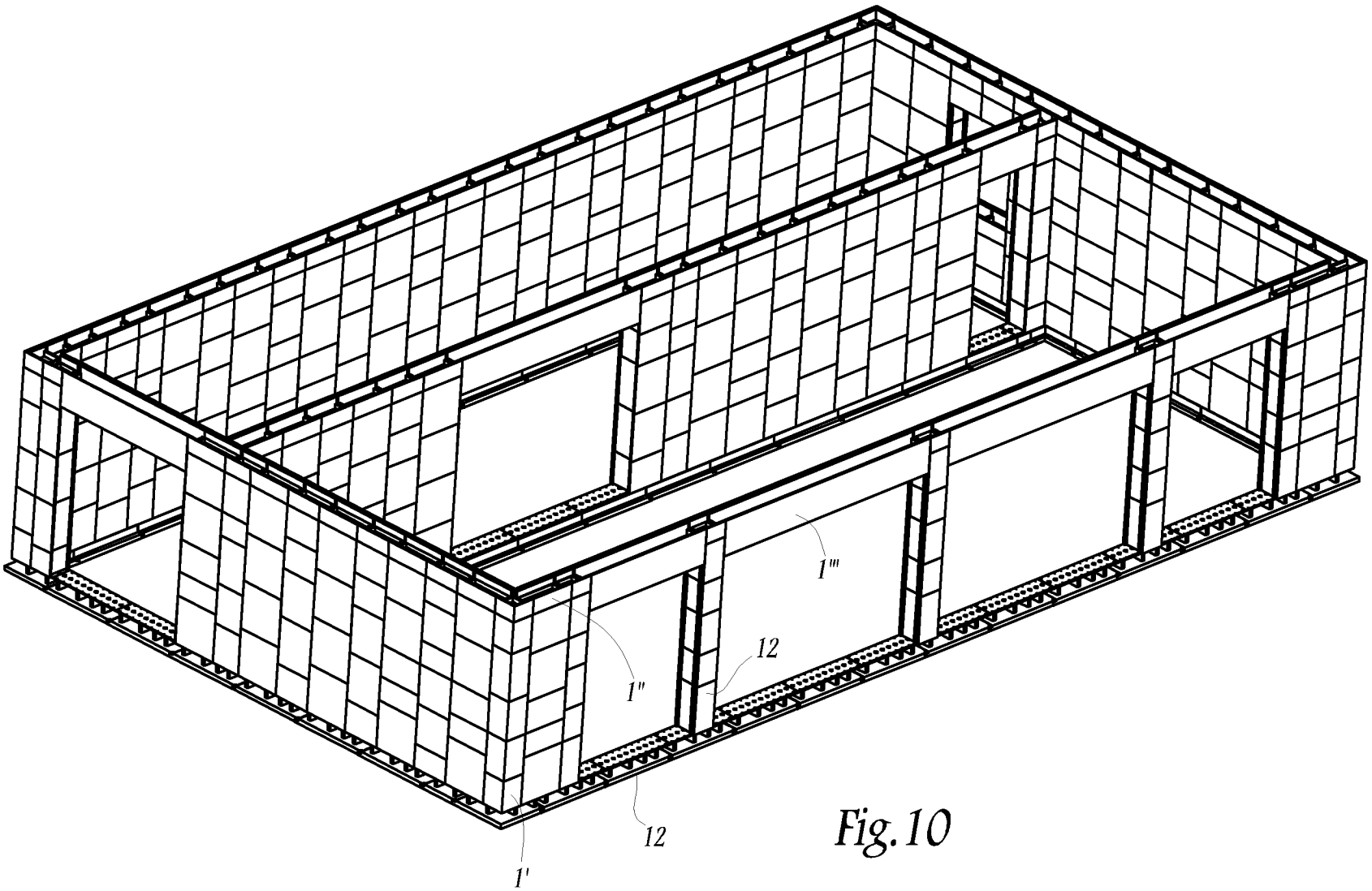
FIG. 10 is a diagrammatic view on a different scale of a building made from first-, second- and third-type elements, only the outer and inner walls being illustrated for better legibility.

As illustrated in FIG. 10, the different bricks 1, 1', 1", 1"', 1"" make it possible to mount as many outside walls as inside walls of a building.

Alternatively, it is possible to mount a temporary wall, such as an exhibition booth. These elements 1, 1', 1", 1"', 1"" can also cover an existing wall, permanently or such that it can be disassembled. Walls of different heights are thus made, with light and insulating elements, i.e. wood bricks.

When a temporary or non-load bearing wall is mounted, a smaller number of the third-type elements, i.e. the tensioning cables, can be used, or in certain cases may be placed only if necessary. In one embodiment that is not illustrated, the insulating plate 10 and the cleats 8, 9 make it possible for the elements, both in the vertical and horizontal directions, to be prefabricated. In other words, a sandwich-type piece is used comprising two wood plates confining an insulating plate, to connect the bricks to one another.

The dimensions of the bricks 1, 1', 1", 1"', 1"" used make it possible to mount walls similar to walls made from standard size bricks or concrete blocks. In other words, the architectural plans for a building made from concrete blocks or bricks are not modified when such building elements 1, 1', 1", 1"', 1"" are used.

The tension members 42 make it possible not only to stiffen the stack of elements 1, 1', 1", 1"', 1"", but also to provide a sealed connection between the latter, removably, with quick mounting and placement.

The stacked elements 1, 1', 1", 1"', 1"" can easily be covered with a decorative material, such as wallpaper or parging. They can also be painted or include raised decorative elements.

On the upper end of the wall, it is possible either to provide for the mounting of a frame, traditional or of the trussed type, or to provide a floor, since such walls can be used to produce buildings with multiple floors.

In one alternative that is not illustrated, the elements of the frame are adapted to receive the cable 42. To that end, the floor 44 is either replaced by said frame element, or it is adapted to receive the latter. In this way, the elements of the roof are secured with the walls of the building, which makes it possible to improve the ability of the building to withstand violent wind.

As an example, the mounting of a wall 2.5 m long by 3 m high is done in 1 hour by one person. The buildings thus made can also be inserted into a structure that is itself load-bearing, for example in a metal frame structure.

The height shift of the elements 1, 1', 1", 1"', 1"" between two adjacent columns prevents any thermal bridge between the inside and outside of the building that may harm the phonic and/or thermal insulation. Alternatively, it is possible, once the building is made, to complete that insulation, on one surface of the wall, with materials that are known in themselves, such as rock wool or cellulose wadding.

The invention claimed is:

1. A set of building elements for constructing a wooden wall comprising a plurality of first elements each provided with connecting members on four faces and structured to be stacked on one another and butted together in edge to edge relationship with at least one other first element, the first elements being formed of a cellulose-based material and having opposite side walls connected by spaced end webs, an open end space formed adjacent one of the end webs, the set of building elements further including:

at least one second element structured to be attached to a flat surface and to form a base for receiving the first elements thereon, and cables for removably connecting the first elements to the at least one second element in assembled relationship, and wherein each cable is connected to the at least one second element, inserted vertically into the open end space of a stack of a plurality of first elements and tensioning means to releasably secure the cable to the stack of first elements.

2. The set according to claim 1, wherein the end space is defined between webs of two horizontally adjacent first elements.

3. The set according to claim 1, including a plurality of second elements and wherein each second element includes a surface provided with openings that are uniformly arranged and each configured for receiving a lower portion of one of the cables.

4. The set according to claim 3, wherein each cable is removably connected between a second element and an uppermost first element arranged at an upper end of the stack of first elements, and the tensioning means secures the cable under tension to the uppermost first element.

5. The set according to claim 4, wherein the second elements include tabs configured in a shape of a Ω and provided with an opening for allowing passage of one end of one of the cables.

6. The set according to claim 1, including a plate inserted into the open end space and a vertical slot in the plate of a size for a cable to extend vertically within the slot.

7. The set according to claim 1, wherein one first element is configured to form a corner of a building.

8. The set according to claim 1, wherein one first element is configured to form a housing for rolling slat blinds.

9. A method for erecting a structure using a set of first and second elements and cables according to claim 1, comprising at least the steps of:

a) assembling the second elements to form a base for walls of a structure, b) stacking the first elements in a first stack on at least one of the second elements and such that the end spaces are vertically aligned, c) positioning a cable between a first element located at a top of the first stack and a second element forming a base for the stack, d) connecting a lower end of the cable to the second element forming a base for the first stack and extending the cable into the vertically aligned end spaces of the first elements, e) putting the cable under tension and securing the cable to the first element at the top of the first stack to thereby secure the first elements forming the first stack to the second element forming the base of the first stack, f) stacking the first elements into a second stack on at least one of the second elements so as to be adjacent to the first stack, and g) joining the first and second stacks in edge to edge relationship.

10. A building comprising at least one wall made from a set of first and second elements and cables according to claim 1.

* * * * *